US005553797A

United States Patent [19]

Axelsson et al.

[11] Patent Number: 5,553,797

[45] Date of Patent: Sep. 10, 1996

[54] GRANULATING MACHINE

[75] Inventors: Sven-Inge S. Axelsson; Åke I. Karlsson, both of Bredaryd, Sweden

[73] Assignee: Meltic AB, Sweden

[21] Appl. No.: 403,781

[22] PCT Filed: Aug. 16, 1993

[86] PCT No.: PCT/SE93/00754

§ 371 Date: Mar. 16, 1995

§ 102(e) Date: Mar. 16, 1995

[87] PCT Pub. No.: WO94/06559

PCT Pub. Date: Mar. 31, 1994

[30] Foreign Application Priority Data

Sep. 16, 1992 [SE] Sweden ..... 9202671

[51] Int. Cl.[6] ..... B02C 19/00

[52] U.S. Cl. ..... 241/285.3

[58] Field of Search ..... 241/285.1, 73, 241/285.2, 60, 285.3

[56] References Cited

U.S. PATENT DOCUMENTS 3,419,223 12/1968 Morin ..... 241/285.3 X
3,756,519 9/1973 Reynolds et al. ..... 241/285.3 X
4,073,444 2/1978 Pav ..... 241/285.3 X
5,435,050 7/1995 Alt ..... 241/285.3 X

FOREIGN PATENT DOCUMENTS 2178675 2/1987 United Kingdom ..... 241/285.3

*Primary Examiner*—Mark Rosenbaum
*Attorney, Agent, or Firm*—Ostrolenk, Faber, Gerb & Soffen, LLP

[57] ABSTRACT

A granulating mill having a cutter which is rotatably disposed in a granulate container. Pieces of material to be comminuted are supplied to the granulate container from a collection hopper. The cutter has shaft ends which are rotatably mounted on a centrally disposed subframe, which is itself pivotably mounted on a main pivot shaft attached to a main frame. The cutter and collection hopper are mutually pivotable about a first pivot, and the granulate container is pivotable about a second pivot. In addition, the cutter, collection hopper and granulate container are pivotable about the main pivot shaft via the subframe. Thus, by this arrangement, the cutter, collection hopper and granulate container require only minimal force for such components to be pivoted into position for servicing and cleaning of the granulating mill.

6 Claims, 3 Drawing Sheets

GRANULATING MACHINE

The present invention relates to an arrangement in granulating mills and includes a cutter means with a cutter rotatably mounted in a granulate container and disposed such that during rotation of the cutter the perimeter of its blades is juxtaposed to a cylindrically shaped sieve made from a perforated sheet of material and removably mounted in the container, the perimeter also being accessible to an upper feed opening for the shaped pieces of primarily plastics material that is to be comminuted, this material being supplied to the feed opening from a collection hopper situated above the cutter blades, which are adapted for coaction with at least one cutter bar disposed in the fixed part of the cutter means for comminuting the plastics material. The shaft ends of the cutter are journalled in bearings in a centrally disposed subframe, which is in turn pivotably mounted via a main pivot shaft journalled at either end in mutually opposing main pivot bearings fixed to the primary frame of the mill. The arrangement also includes a high pressure pump for conveying air through a first hose into the lower portion of the container and for conveying the ready milled granulate via a second hose away from the container to a collection point outside the mill.

A problem burdening already known granulating mills of a similar type is that service and cleaning in connection with changing pigment or other material are troublesome and time-consuming, as well as being very laborious, since the components included in the mill have considerable weight, which comes into prominence in the dismantling necessary to get at the mill components which are to be serviced, exchanged or cleaned. It is important that cleaning is carried out very thoroughly when changing pigment or other material, since pieces or granules from a previous comminuting operation with the mill can otherwise loosen and discolour the granulate in a subsequent operation.

The object of the present invention is thus to achieve an arrangement in granulating mills of the kind mentioned in the introduction, where both service and cleaning in connection with changing pigment or other material are substantially facilitated. The distinguishing features required for the invention are disclosed in the accompanying claims.

By reason of the invention there has now been provided an arrangement in granulating mills of the kind mentioned above, and which excellently achieves the inventive intention, while being at the same time relatively cheap and simple in its construction. The arrangement is unique in that all the chief components of the mill (excluding its main frame) are suspended by a shaft, about which they pivot from a closed state to an open state. Since the components are adapted such that their common centre of gravity has its line of action substantially passing through the shaft, this results in that these components will be apparently almost weightless during opening and closing the mill. At the same time, after the mill has been opened by swinging apart the components forming it, all the nooks and crannies of the apparatus become readily accessible for effective cleaning, this better accessibility ensuring that service can be performed more easily than with previously known arrangements. In addition, no special tools for opening up the mill are required, since the parts to be opened are kept together by bayonet-type latches, which can be rapidly opened. This means that the entire service and/or cleaning procedure does not take a long time, which is the case with known mill arrangements, thus enabling very rapid, time-saving procedures. In connection with swinging or tipping the pivotable chief components of the mill to the open state, the granulate container opens automatically, and on termination of the tipping operation, a pivoting shaft for the upper components comprising the cutter and collection hopper, assumes a vertical position, which enables swinging the collection hopper out laterally with the use of practically no force at all.

The invention will now be described in more detail below with the aid of a preferred embodiment example, and with reference to the accompanying drawing, where:

Figure 3:
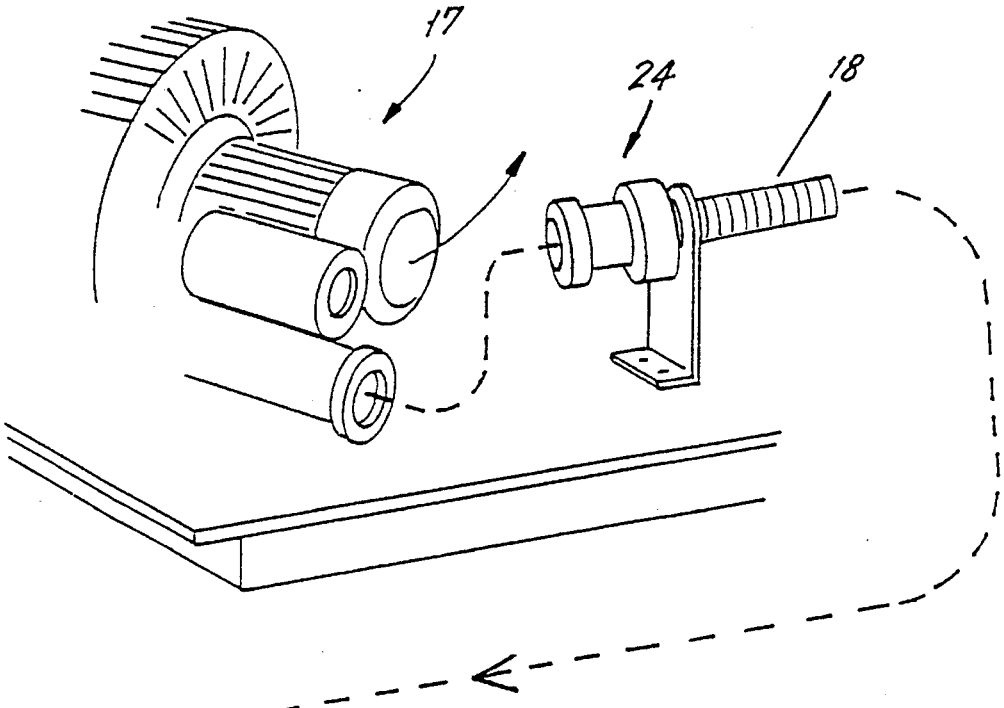
Figure 4:
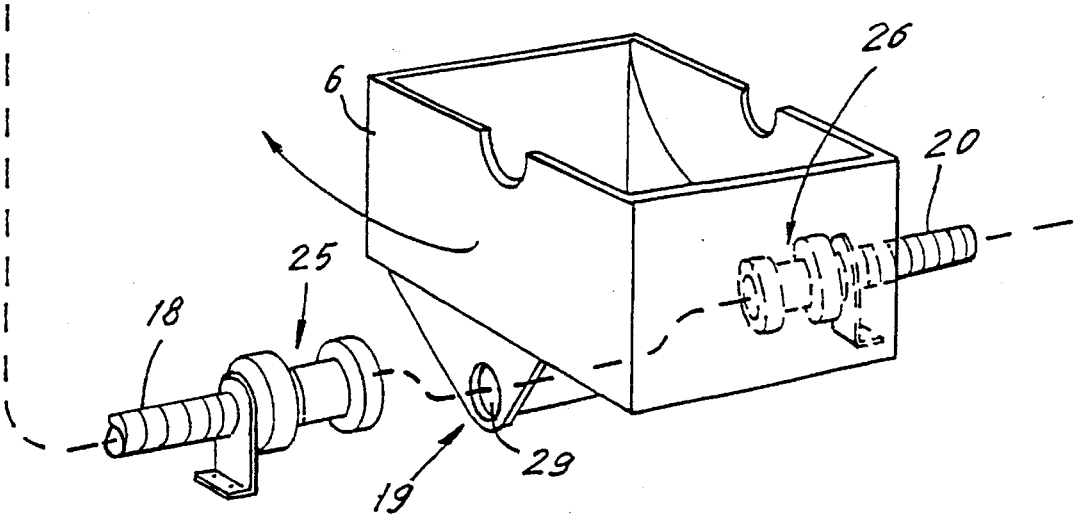

FIG. 3 is a partial, schematic, perspective view of a part of the mill arrangement in accordance with the invention, more specifically a high pressure pump in its swung out position, the pump being intended for conveying air through a supply hose, towards which the pump may be swung such that a sprung hose connection on the pump mates with the hose, and FIG. 4 is a partial, schematic, perspective view of the mill, more specifically the sprung hose connections for sealing engagement against air input and output openings in the lower portion of the granulate container.

Figure 1:
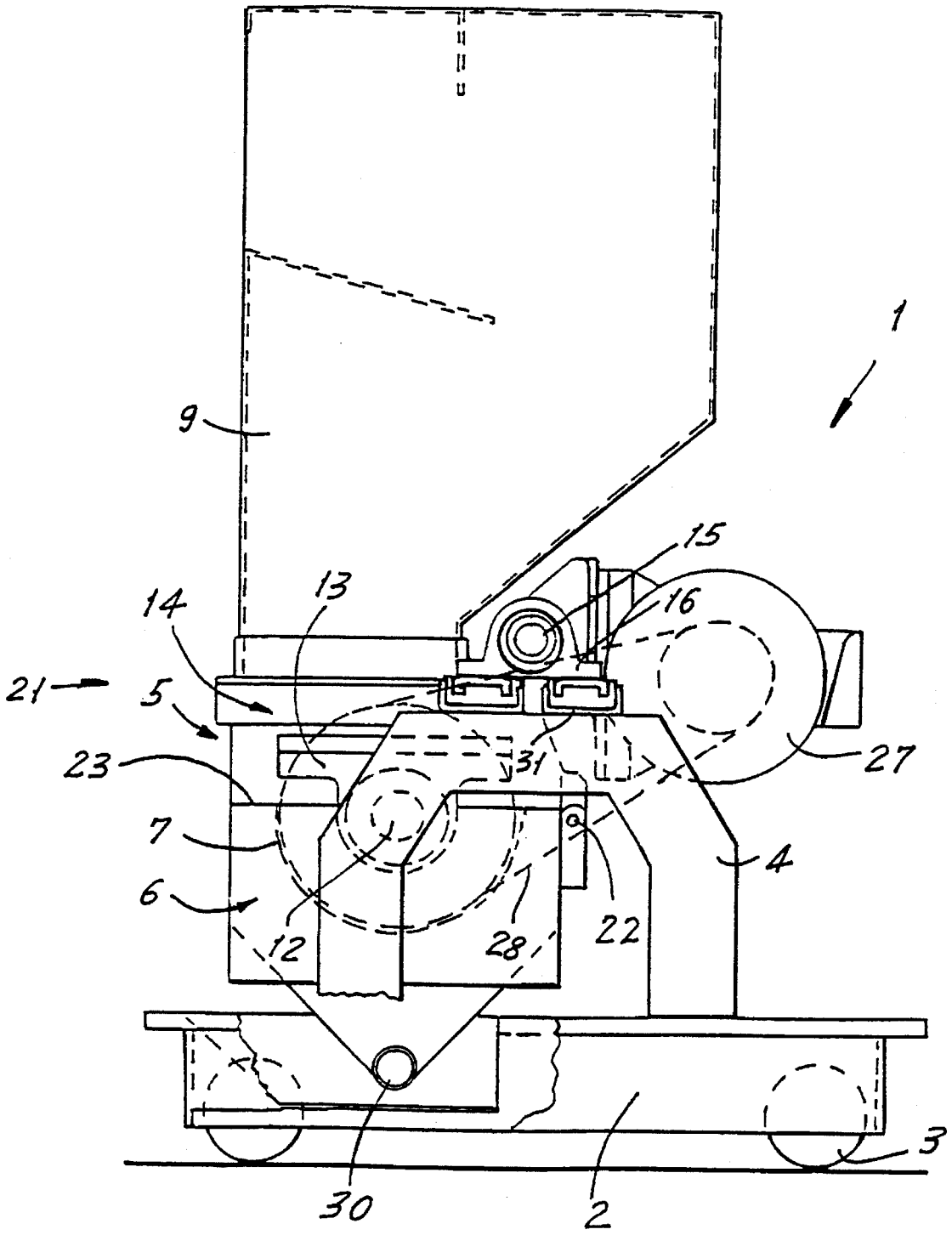
FIG. 1 is a schematic side view of a granulating mill, arranged in accordance with the present invention, in an operative, closed state.
Figure 2:
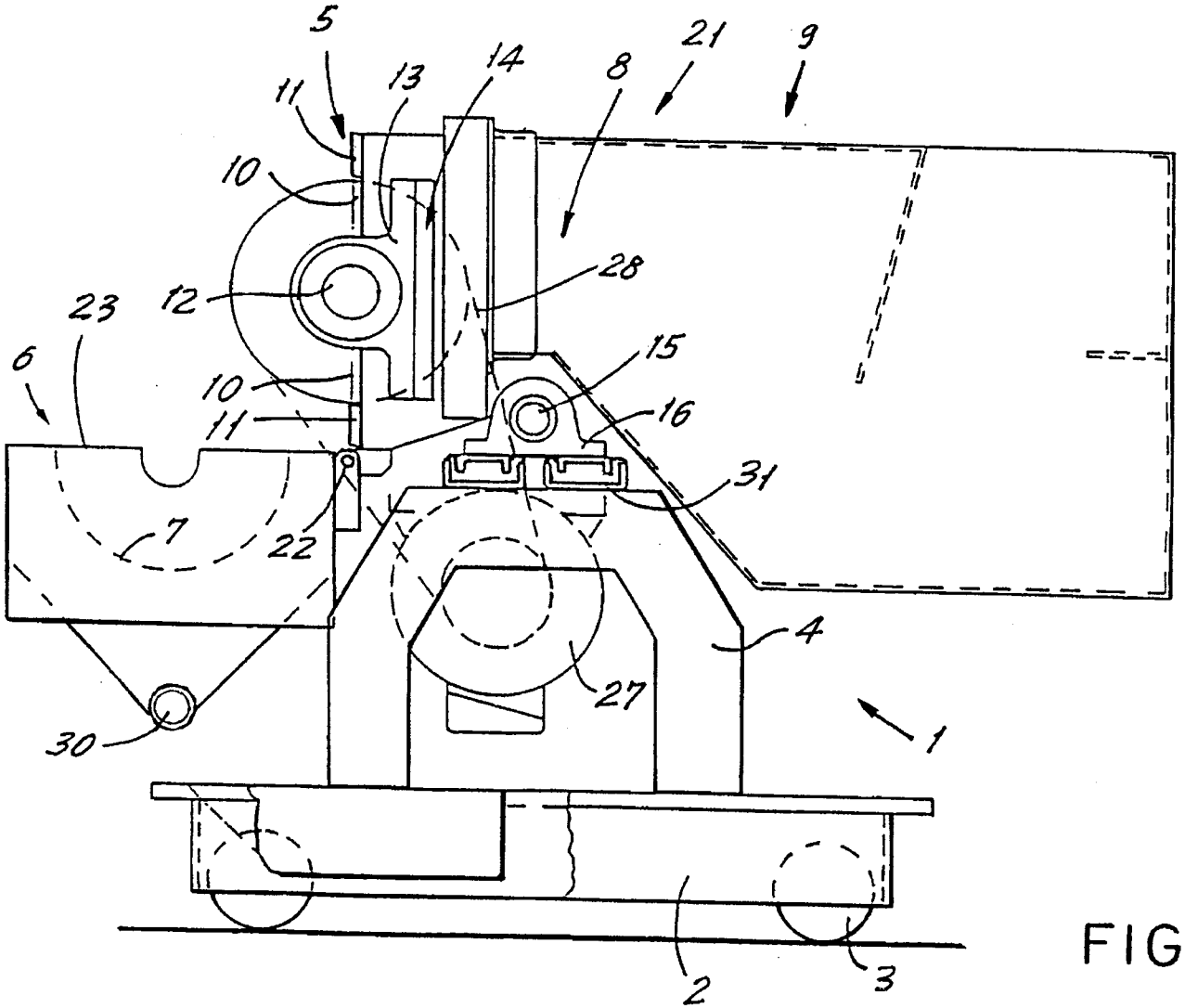
FIG. 2 illustrates the mill of FIG. 1 in an open state, preliminary to cleaning and/or service.

As will be seen from FIGS. 1 and 2, the granulating mill 1, according to a preferred embodiment example of the invention, includes a main frame 4 mounted on a carriage 2, which is movable with the aid of wheels 3. The frame 4 carries a cutter 5 journalled for rotation in a granulate container 6. The cutter is provided with blades 10, the periphery of which during rotation is juxtaposed to a removable, semi-cylindrically shaped sieve 7 of perforated sheet material, removably arranged in the container 6. The mill also includes a collection hopper 9, and shaped pieces of primarily plastics material which are to be comminuted are supplied via a feed opening 8 of the hopper 9, this opening being in communication with the cutter 5. For comminuting the plastics material the blades 10 of the cutter 5 coact with at least one cutter bar 11 situated on the fixed part of the cutter means, the cutter shaft ends 12 of which are mounted for rotation by means of bearings 13, in turn mounted on a centrally placed subframe 14. The subframe 14 is pivotably mounted on a main shaft 15, in turn mounted in pivot bearings 16 rigidly fastened to the main frame 4 of the mill 1. The latter also includes a high pressure pump 17 for conveying air in a first hose 18 into the lower portion 19 of the container 6 via an input opening 29, ready milled granulate being conveyed in a second hose 20 via an output opening 30 in the portion 19 to a collection point outside the mill 1.

The cutter 5 and collection hopper 9 are mutually pivotable via means 21, while the granulate container 6 is pivotable via means 22, these components being openably, mutually connected via unillustrated bayonet fastenings, and they are also pivotable about the main pivot shaft 15 via the central subframe 14 carrying the cutter means. The line of action of the common centre of gravity of these components 5, 6 and 9 substantially passes through the shaft 15, about which they are pivotable and balanced, whereby only minor force is required to swing them into position for opening the mill 1 when service and/or cleaning are required in connection with changes in pigment/material.

As indicated in FIGS. 1 and 2, the pivot means 22 extends between the cutter 5 and granulate container 6 parallel to the main pivot shaft 15. When the unit formed by the cutter 5 and hopper 9 is swung about the shaft 15 to the open position, the granulate container 6 in the lower portion of the mill is opened up as the container 6 moves about its pivot means 22. These movements reveal an opening plane formed by the upper edge of the container along an opening line 23 as the container is lifted from a lower, closed position to its upper, open position.

The pivot means 21 between the cutter 5 and collection hopper 9 extends transverse the main shaft 15. The result of this is that after pivoting the unit (5 and 9) about the main shaft 15 and lifting the granulate container 6 to its upper, open position, wherein its opening plane forms substantially 90 degrees to the pivot means 21, it will now be possible to release the bayonet fastening between the cutter 5 and hopper 9. Since the pivot means 21 is now vertically oriented, the hopper 9 requires very small force to move it radially about the pivot means 21, which is an important feature of the mill arrangement in accordance with the invention, and it contributes to the easy and simple opening procedure.

As will be seen from FIGS. 3 and 4, a high pressure pump 17 is provided, also in the lower portion of the mill 1, for conveying the ready comminuted granulate away from the mill. In order to facilitate service and/or cleaning, this pump is also pivotable laterally before tipping the unit (5 and 9) about the shaft 15 and releasing the bayonet fastening between components 5 and 9. For this purpose the pump is provided with a hose connection means, which includes a spring-loaded, compressible connector 24 on the first hose 18, the other end of which has in turn such a connector 25 for mating with a connection means at the bottom portion 19 of the container 6. At the other side of the bottom portion 19 there is a similar connection means including a connector 26 on a second hose 20, which is for conveying ready comminuted granulate away from the container. The cutter drive is from a motor 27 via V-belts 28. Rubber dampers 31 are placed under the main shaft bearings 16 to prevent transmission of vibrations from the cutter 5 to the main frame 4 and further to the substructure supporting the mill 1. Noise from the mill is mitigated with the aid of a sound insulating casing (not illustrated on the drawing). This casing preferably comprises two halves with mutual hingeing and adapted such as to be pivotable on the main frame 4. The halves are also arranged so that when they are opened safety switches are operated for interrupting current supply to the electrical components of the mill.

Opening the mill 1, provided with the inventive arrangement, is performed in the following manner: The first step is to unlatch the sound insulating casing halves, thus interrupting electrical supply to the mill, and then swing the halves clear. The second step is to release a lock on the pump and swing it to one side. The third step is to release the bayonet catch locking the granulate container 6 to the cutter 5, and then to swing the unit formed by the chief mill components 5, 6 and 9 about the main pivot shaft 15 through approximately 90 degrees to the open position of the mill. During this pivoting or swinging movement, the granulate container 6 is automatically raised simultaneously as its plane of opening maintains a substantially horizontal orientation along the line 23 of opening as the container becomes completely open. The pivot means 21 on the hopper 9 is now in a substantially vertical position and preferably at an angle of approximately 90 degrees to the line 23 of opening of the container 6. The fourth step is now taken in this completely pivoted position, namely to release the bayonet catch keeping the hopper 9 to the cutter means, thus enabling the hopper readily to be swung to one side. After service and/or cleaning the reverse procedure is performed for returning the completely opened mill to its operational state, subsequent to which the mill can function once again.

We claim:

1. A granulating mill, comprising: a cutter disposed for rotation in a granulate container, a collection hopper having a feed opening for supplying to the granulate container pieces of material to be comminuted, shaft ends of said cutter being rotatably mounted on a centrally disposed subframe, said subframe being pivotably mounted on a main pivot shaft which is mounted on a main frame of the granulating mill, a high pressure pump being provided for generating an air stream to convey ready comminuted granulate out from the granulate container, the cutter, collection hopper and granulate container being hingedly connected to each other via first and second pivot means, and the cutter, collection hopper and granulate container being pivotable about the main shaft via the central subframe carrying the cutter, wherein a line of action of a common center of gravity of the cutter, collection hopper and granulate container, substantially passing through said main shaft such that said cutter, collection hopper and granulate container are statically balanced about it, thereby requiring only minor force to pivot the cutter, collection hopper and granulate container into position for opening the mill for service and/or cleaning.

2. The granulating mill as claimed in claim 1, wherein the second pivot means between the cutter and granulate container extends parallel to the main shaft, such that when a unit including the cutter and collection hopper is pivoted about the main shaft a lower portion of the granulating mill, including the granulate container, which is carried by the second pivot means, is simultaneously opened such that at its upper edge forming an opening plane along an opening line of the granulate container is raisable from a lower, closed position to an upper, opened position.

3. The granulating mill as claimed in claim 2, wherein the first pivot means between the cutter and collection hopper extends transverse to the main shaft, and the cutter is adapted to be swung to one side to open an upper part of the granulating mill, after pivoting or swinging a unit including the cutter and collection hopper about the main shaft to an open position while simultaneously lifting the granulate container to its upper, open position where an opening plane forming an opening line is substantially at right angles to the first pivot means.

4. The granulating mill as claimed in claim 1, wherein the first pivot means between the cutter and collection hopper extends transverse to the main shaft, and the cutter is adapted to be swung to one side to open an upper part of the granulating mill, after pivoting or swinging a unit, including the cutter and collection hopper about the main shaft to an open position while simultaneously lifting the granulate container to an upper, open position where an opening plane forming an opening line is substantially at right angles to the first pivot means.

5. The granulating mill as claimed in claim 1, wherein before the cutter and collection hopper of the granulating mill are swung about the main shaft into an open position, the high pressure pump is adapted to be swung to one side and is engageable with first connection means at an end of a first hose for supplying air to a lower portion of the granulate container, the first hose is provided with a second connection means at its other end for connection to the lower portion of the granulate container, and a second hose for conveying ready comminuted granulate away from the granulating mill is connected by a third connection means to the lower portion of the granulate container.

6. The granulating mill as claimed in claim 5, wherein said first, second and third connection means are spring-loaded and compressible.

* * * * *